US006020544A

United States Patent [19]

Jones et al.

[11] Patent Number: 6,020,544

[45] Date of Patent: Feb. 1, 2000

[54] PIANO SOSTENUTO ASSEMBLY

[75] Inventors: Marvin S. Jones, Port Washington; Peter M. Barna, Yonkers; William S. Youse, Hewlett; Anthony C. Arena, Forest Hills; Michael Mohr, Huntington, all of N.Y.

[73] Assignee: Steinway, Inc., Waltham, Mass.

[21] Appl. No.: 09/097,207

[22] Filed: Jun. 12, 1998

[51] Int. Cl.[7] ..... G10C 3/00

[52] U.S. Cl. ..... 84/218

[58] Field of Search ..... 84/216–218

[56] References Cited

U.S. PATENT DOCUMENTS

| | | | |
|---|---|---|---|
| 3,747,461 | 7/1973 | Yui | 84/218 |
| 4,028,980 | 6/1977 | Hill et al. | 84/218 |
| 4,335,640 | 6/1982 | Mudgett | 84/218 |

*Primary Examiner*—Jeffrey Donels
*Attorney, Agent, or Firm*—Fish & Richardson P.C.

[57] ABSTRACT

A piano includes an underlever assembly having an underlever arm and an underlever support joining the underlever arm to a string damper. The underlever arm is mounted to move between an at-rest position and a second position. A latch is mounted to a latch mount for movement between non-latching and latching positions. In latching position, the latch engages a latch surface of the underlever support to maintain the string damper spaced from a corresponding piano string. A stop mounted to the latch mount limits movement of the underlever arm toward its second position. A method for controlling a piano string damper includes contacting the underlever arm with the latch to maintain the string damper spaced from the string, and contacting the underlever arm with the stop to limit movement of the underlever arm.

16 Claims, 18 Drawing Sheets

PIANO SOSTENUTO ASSEMBLY

BACKGROUND OF THE INVENTION

The invention relates to a piano sostenuto assembly for a grand piano.

In a piano, sound is created when a pianist presses upon a piano key, lifting a damper off a tensioned string and triggering a hammer to strike the tensioned string. When the piano key is released, the damper lowers to contact the string and stop the string from vibrating. If the pianist wishes to prevent the damper from lowering when the piano key is released, a damper pedal is pressed to raise and hold all of the string dampers lifted from their respective strings. Alternatively, the pianist can press a sostenuto pedal to hold already raised dampers in their lifted positions, leaving remaining dampers in contact upon the strings.

Referring to FIG. 1, when a pianist at a prior art grand piano presses down on a piano key 25, a soft key end felt 26 is raised (arrow 26*a*) into contact with an underlever 17 associated with the particular key 25. The motion of the piano key acts to raise the underlever (arrow 17*a*) and the topflange 15 attached to the underlever. A damper head 11 is associated with each underlever 17. A damper wire 13 connecting topflange 15 to damper head 11 transmits the upward motion of topflange 15 to damper head 11 to raise damper head 11 off of a tensioned string 12. The upward motion of underlever 17 is limited by contact of underlever 17 with a felt pad 24 of a damper stop rail 22.

To disengage all of the damper heads 11 from their respective strings 12, the pianist depresses a damper pedal 33, which acts through a series of connections (indicated generally at 30) to cause a damper tray 27 to move upward (arrow 27*a*), contacting and raising each of the underlevers 17. The motion of the underlevers is transmitted to the damper heads as described above.

Referring to FIG. 2A, also representing prior art, once in a lifted position, individual or multiple dampers can be held in elevated position by depressing a sostenuto pedal 52. The motion of pedal 52 causes a rod 51 attached to pedal 52 to be raised, causing a sostenuto pedal lever 50 to pivot about a connection point 53 (arrow 54) lowering a connecting rod 48 (shown in dashed line). Referring also to FIG. 2B, a sostenuto rail 40, mounted to an action frame 110 (FIG. 1) of the piano by a bracket 112, clamp 112*a* and bolt 112*b*, is connected to an end piece 48*a* of rod 48 by a wire loop 49 which is engaged in notch 48*b* and secured to the end piece 148*a* by clamp 49*a* and bolt 49*b*. Rail 40 is free to rotate within a curved section 112*c* of bracket 112 but is prevented from moving vertically.

The motion of rod 48 causes sostenuto rail 40 to be rotated about pivot point 56 (arrow 58). Rotation of sostenuto rail 40 causes a rail blade 41 to engage the underside 60 of a felt covered latch surface, tab nose 47, of all lifted topflanges 15 (shown in dashed line). Rail 40 acts to hold the raised damper head(s) off string 12 after key 25 has been released.

Referring again to FIG. 2A, tab nose 47 extends from a damper lever tab 42 pivotally mounted to topflange 15 by a center pin 43. A wire spring 45 biases tab 42 upward toward engagement with a stop felt 46. This arrangement permits the tab to be immovable in the upward direction but flexible in the downward direction. As a result, the pivoting sostenuto blade 41 can capture any designated damper in the lifted position while allowing uncaptured dampers to move freely upward, pushing their downwardly flexible tabs against the lower surface of the extended sostenuto blade. The newly raised damper is then captured in the lifted position.

SUMMARY OF THE INVENTION

In the prior art assembly described above, the damper stop function is performed by one component, stop rail 22, while the sostenuto function is performed by a second component, sostenuto rail 40. According to the invention, these two components are consolidated into a single stop rail possessing both damper stop and sostenuto functions.

A piano includes an underlever assembly having an underlever arm and an underlever support joining the underlever arm to a string damper. The underlever arm is mounted for movement between a first, at-rest position and a second position. Movement of the underlever arm causes movement of the string damper. The underlever support defines a latch surface. A latch is mounted to a latch mount for movement between a non-latching position and a latching position. In its latching position, the latch engages the latch surface to maintain a position of the underlever assembly such that the underlever arm is spaced from its first, at-rest position and the string damper is spaced from a corresponding piano string. A stop mounted to the latch mount limits the motion of the underlever arm toward the second position.

Embodiments of this aspect of the invention may include one or more of the following features. The latch is mounted to the latch mount to rotate between the latching position and the non-latching position. The underlever arm includes a stop surface and the stop is configured to contact the stop surface to limit movement of the underlever arm toward the second position. The stop is a surface of the latch. The latch mount is adjustably mounted to the piano. The latch mount is case-mounted or action-mounted. The latch surface is flexible or rigid. Preferably, an actuator transfers motion of a pedal to the latch. The actuator is adjustably mounted to the piano. The actuator is attached to the pedal by a fastener extending through a loop end of the actuator. The latch mount is configured to be lifted by motion of a pedal.

According to another aspect of the invention, a piano includes an underlever assembly having an underlever arm mounted for movement between a first, at-rest position and a second position. An underlever support joins the underlever arm to a string damper such that movement of the underlever arm between its first position and its second position causes movement of the string damper. The underlever support defines a flexible, triangular tab. A blade having a beveled edge is mounted to a vertical bracket for movement between a non-latching position and a latching position. The blade in its latching position engages the tab to maintain a position of the underlever assembly such that the underlever arm is spaced from its at-rest position and the string damper is spaced from a corresponding piano string. A stop limits the motion of the underlever arm toward its second position. The stop is mounted to the bracket.

According to another aspect of the invention, a method for controlling a piano string damper includes contacting an underlever arm of a piano with a latch mounted to a latch mount of the piano to maintain a position of the underlever arm. An underlever support joins the underlever arm to the string damper such that the string damper is maintained spaced from a corresponding piano string when the underlever arm contacts the latch. The method includes contacting the underlever arm with a stop mounted to the latch mount. The contact of the underlever arm with the stop acts to limit movement of the underlever arm from an at-rest position.

Advantages of the invention include that the joining of the stop and sostenuto rails in one component maintains their correct positions in relation to one another. Also, by positioning the damper stop rail relatively closer to the free end of the underlever than has previously been considered, the damper stop rail can be positioned closer to the surface of the underlever without jamming of the underlever against the damper stop when the underlever is raised. Closer positioning of the da per stop rail to the surface of the underlever, and thus a reduction in the upward travel of topflange 15, reduces rotation of the damper lever tab 42 to accommodate variations in the placement of the stop and sostenuto rails enabling simplified tab designs. The easily removable system provides improved accessibility to the damper system for service purposes since both the sostenuto and stop rail can be removed simultaneously.

Other features and advantages will be apparent from the following description of a presently preferred embodiment, and from the claims.

DESCRIPTION OF THE PREFERRED EMBODIMENTS

Figure 3A:
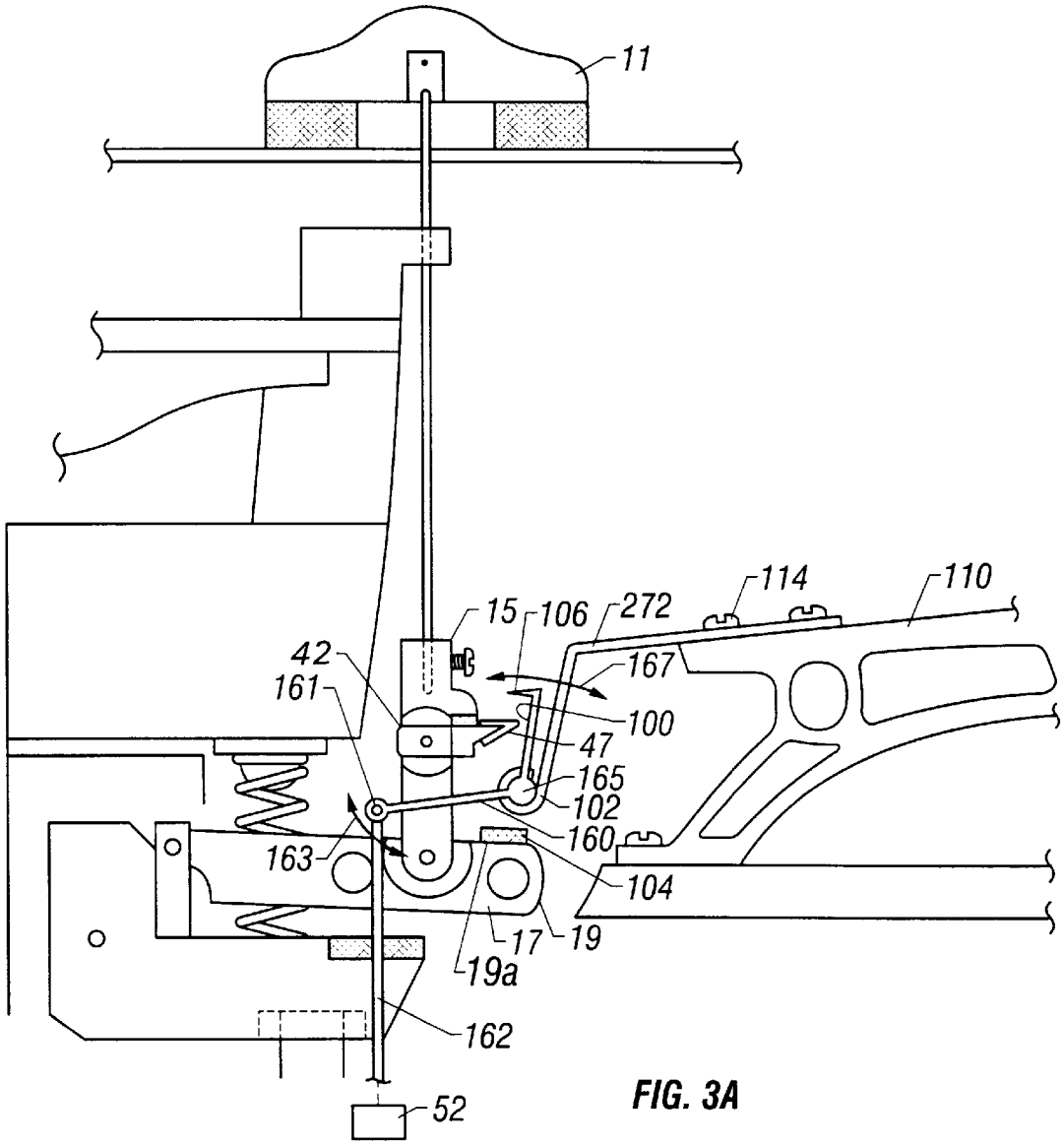
FIGS. 3A and 3B illustrate a sostenuto/damper stop rail according to the invention.

Referring to FIG. 3, a combination sostenuto/damper stop rail 100 performs both the damper stop rail function of damper stop rail 22 of the prior art, and the sostenuto function of sostenuto rail 40 of the prior art. Stop rail 100 includes a damper stop 102 which stops the upward motion of underlevers 17 when a stop felt 104 on an underlever contacts damper stop 102. Stop rail 100 also includes a sostenuto latch blade 106 which is actuated by sostenuto pedal 52 to capture dampers 11 in their lifted position.

Figure 3B:
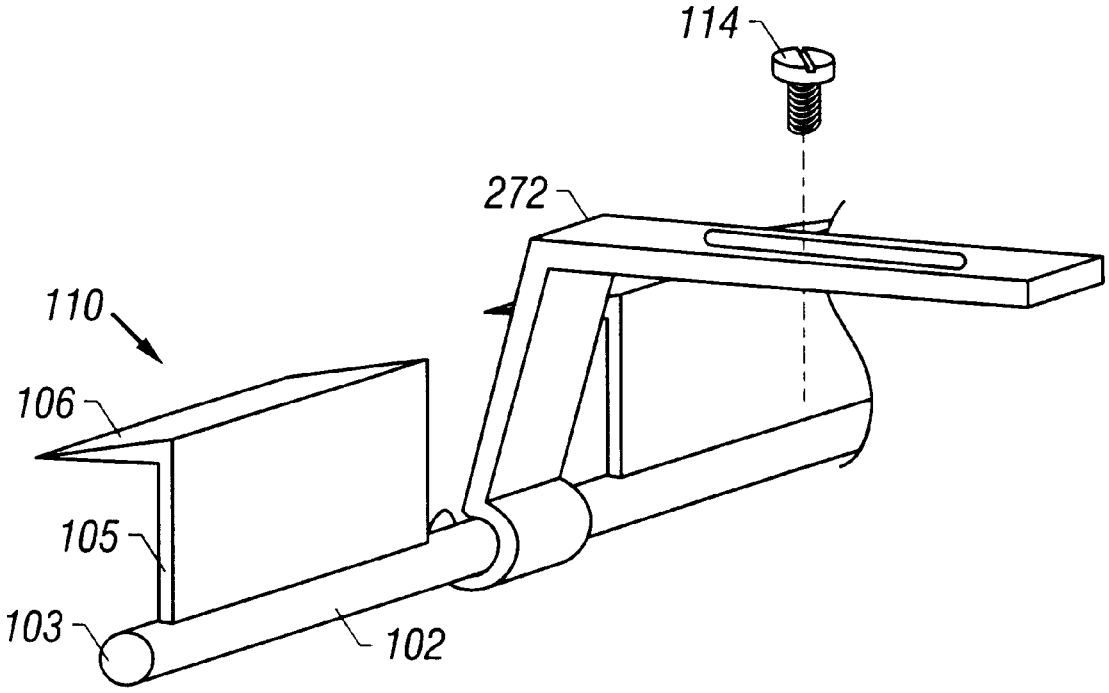

Referring also to FIG. 3B, stop rail 100 is supported on action frame 110 of the piano by brackets 272 (one bracket being shown). Each bracket 272 is attached to frame 110 by, e.g., a hanger screw 114. A cylindrical section 103 of stop rail 100 is rotatably mounted within brackets 272 and defines damper stop 102. A latch mount arm 105 extends from section 103 to support sostenuto blade 106. Arms 105 and brackets 272 alternate along the length of section 103. The position of stop rail 100 can be adjusted by bending bracket 272, sliding the bracket along the frame, and/or adjusting screws 114.

Figure 1:
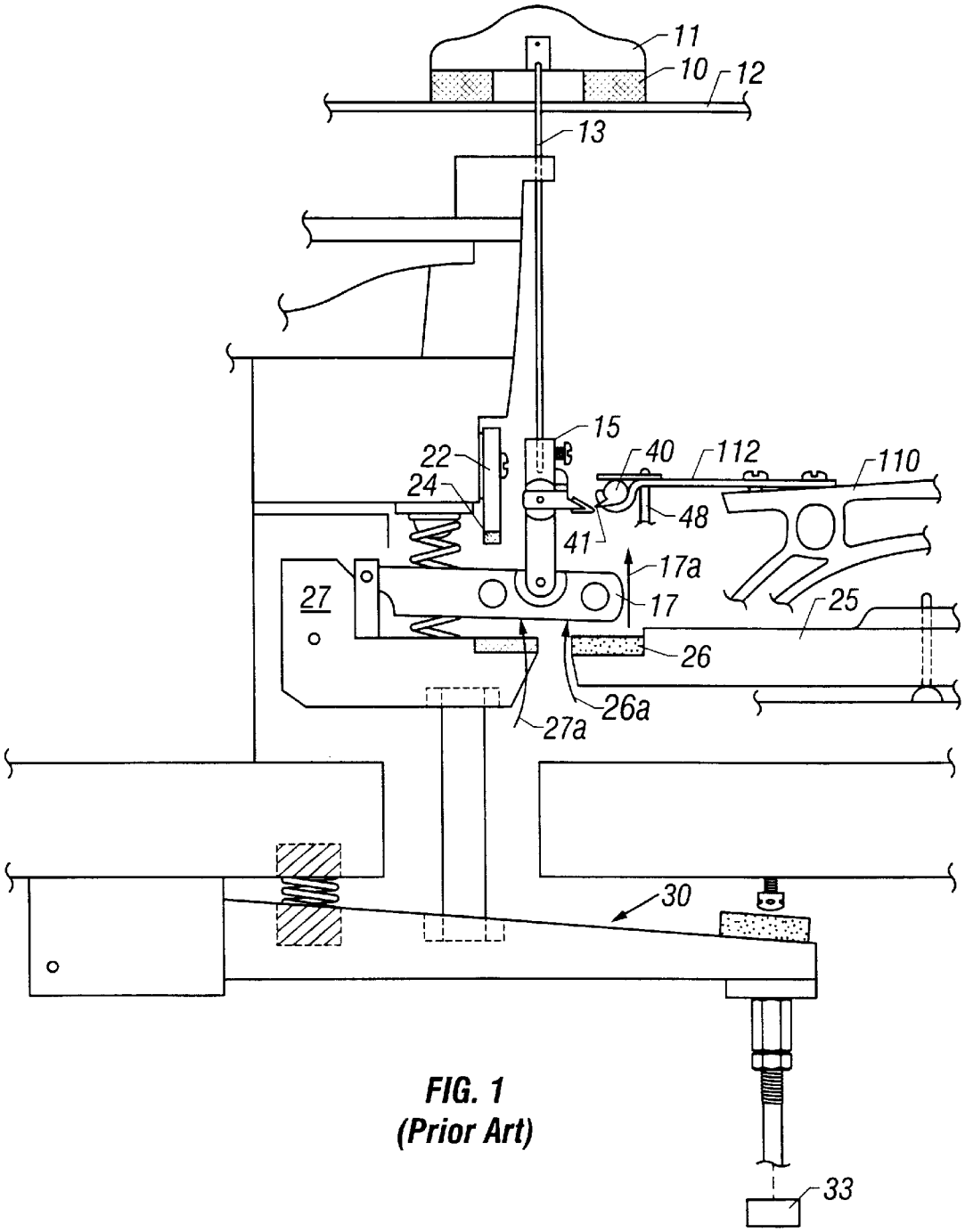
FIG. 1 (Prior Art)
FIG. 1 is an illustration of a prior art damper stop rail and sostenuto rail.
Figure 2A:
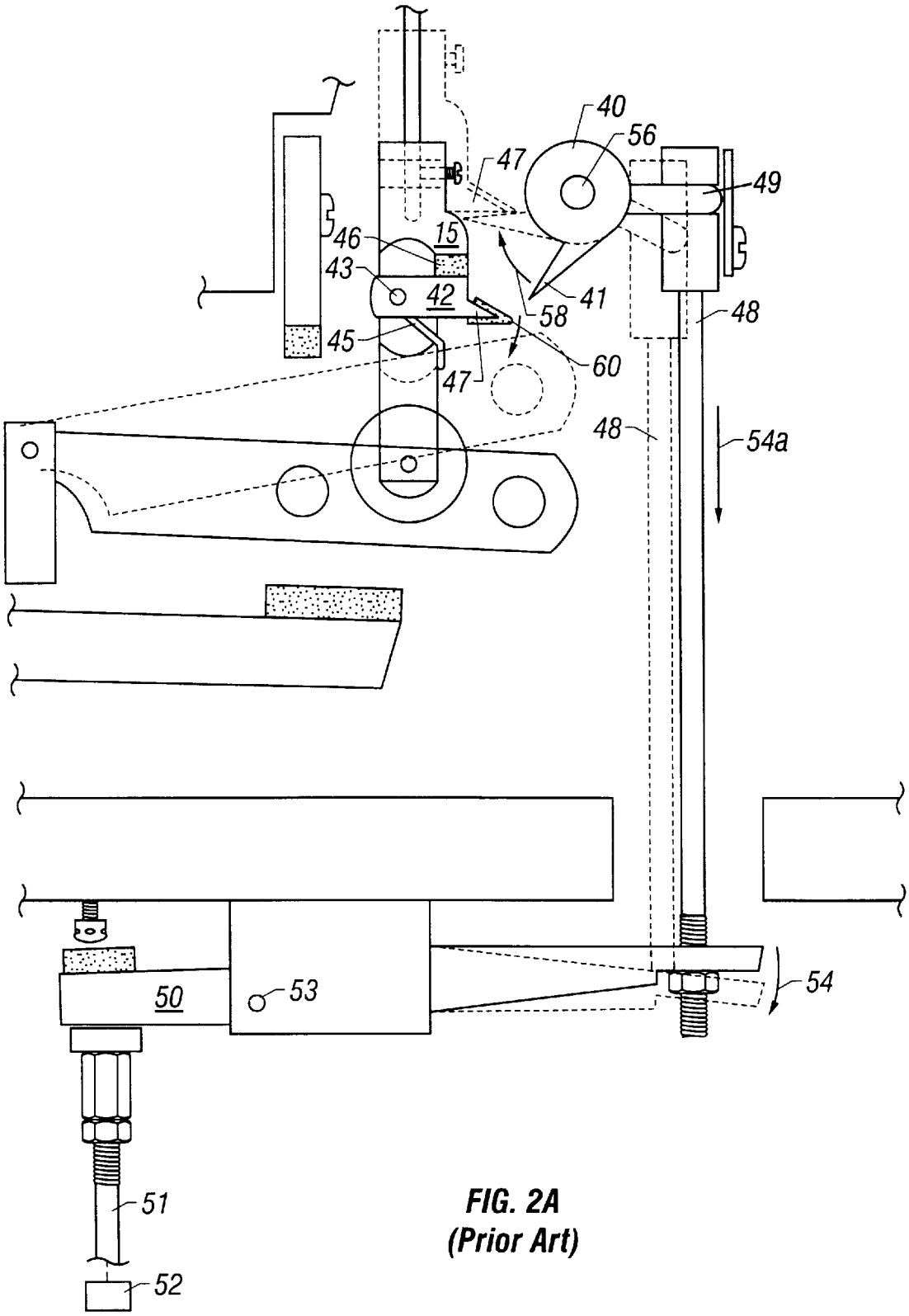
FIG. 2A (Prior Art)
FIGS. 2A and 2B show the prior art sostenuto rail of FIG. 1 in more detail.
Figure 2B:
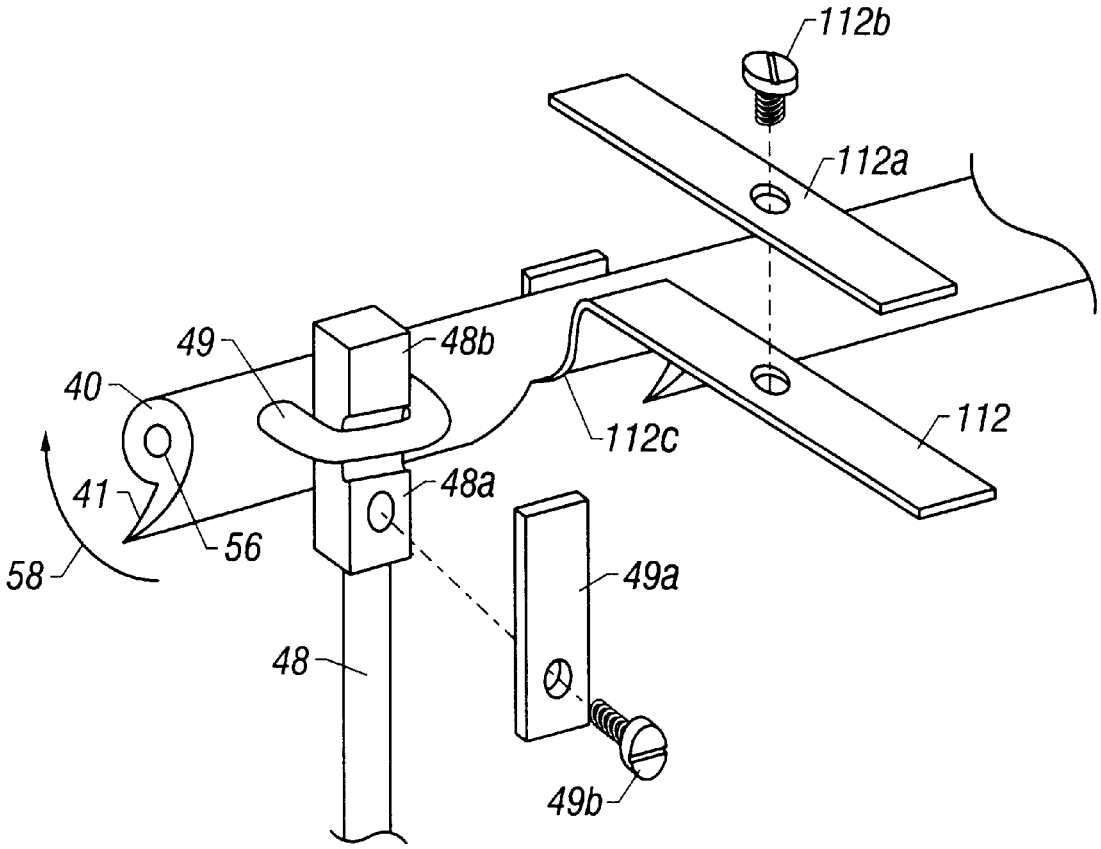
FIG. 2B (Prior Art)

Referring again to FIG. 3A, stop rail 100 is linked to sostenuto pedal 52 by a loop, arm or similar extension 160 extending from stop rail 100, and an adjustable push/pull rod 162 attached at one end to extension 160 at a pivoting joint 161 and attached at its opposite end to pedal lever 50 (FIG. 2A). Motion of rod 162 caused by depressing sostenuto pedal 52 causes motion of joint 161 along arrow 163 and rotation of stop rail 100 about pivot point 165 (arrow 167).

The horizontal relocation of the damper stop 102 toward the free end of underlever 17 allows damper stop 102 to be positioned closer to the surface 19*a* of the underlever without resulting in jamming of the underlever against the damper stop when the underlever is raised. Such jamming has been known to occur when a prior art damper stop, located near the fixed end of the underlever, is vertically positioned over and very close to a key-elevated underlever and the underlever is subsequently elevated at its fixed end by a damper pedal. This results in the underlever being elevated to a higher position than when raised by either the key or pedal alone and can cause jamming of the underlever against the damper stop.

Because the invention permits closer positioning of the damper stop rail to the surface of the underlever, and thus a reduction in the upward travel of topflange 15, the damper lever tab 42 does not have to rotate as far as in prior art systems to accommodate variations in the placement of the stop and sostenuto rails, thus enabling simplified tab designs.

Other embodiments are within the following claims.

Figure 4:
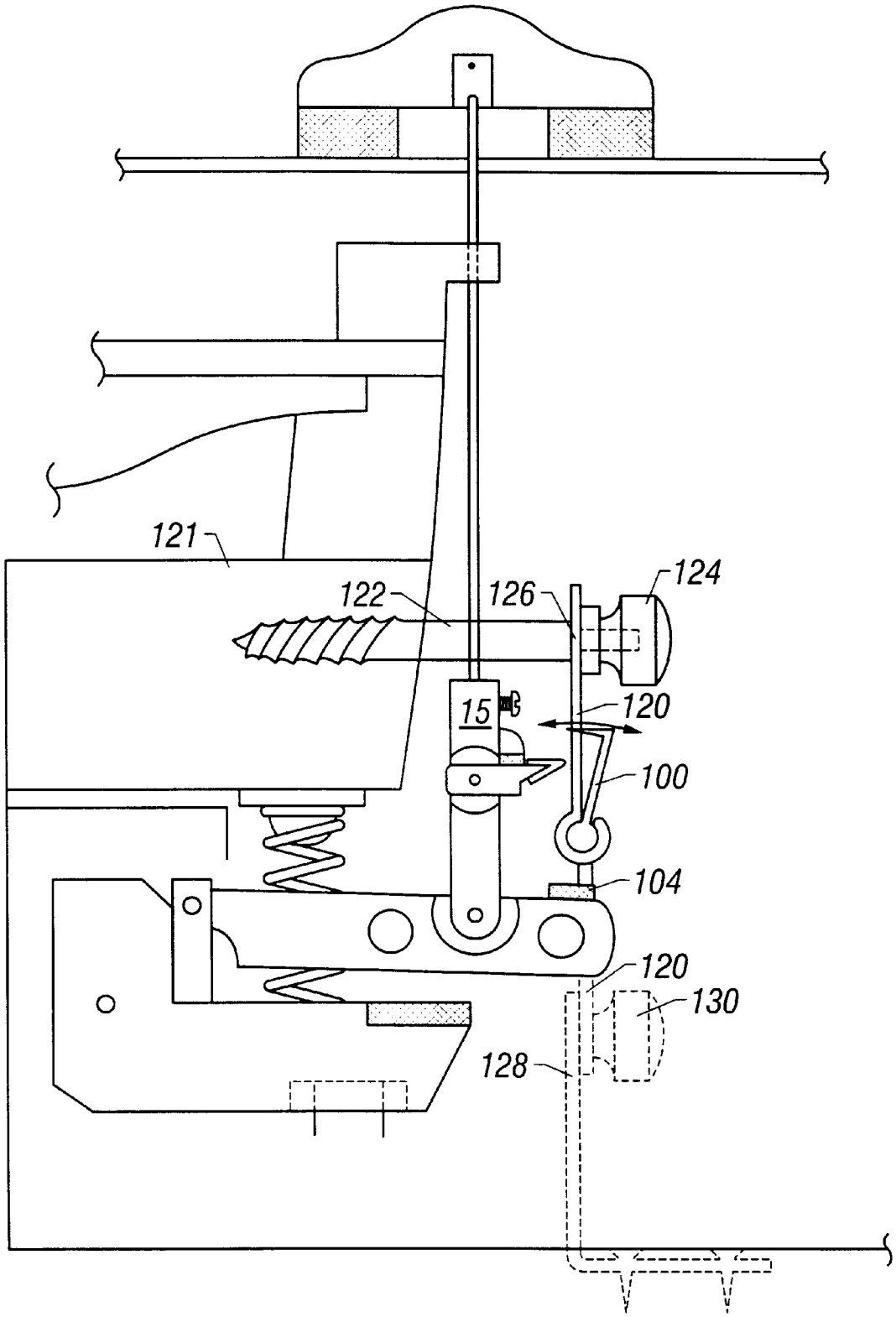
FIG. 4 shows alternative embodiments for mounting the stop rail of FIG. 3 to a piano.

For example, referring to FIG. 4, stop rail 100 is shown mounted to a piano by a vertical rail hanger bracket 120 which is fixed to the piano case 121 by a case-mounted bracket bolt 122 and bolt thumbscrew 124. Bracket 120 is slotted at 126 to permit vertical adjustment of stop rail 100, and rotation of bracket bolt 122 permits horizontal adjustment of stop rail 100. Alternatively, brackets 120 can be case-mounted in the downward direction by using a keybed-mounted bracket 128 and locking thumbscrew 130 (shown in dashed lined).

Figure 5B:
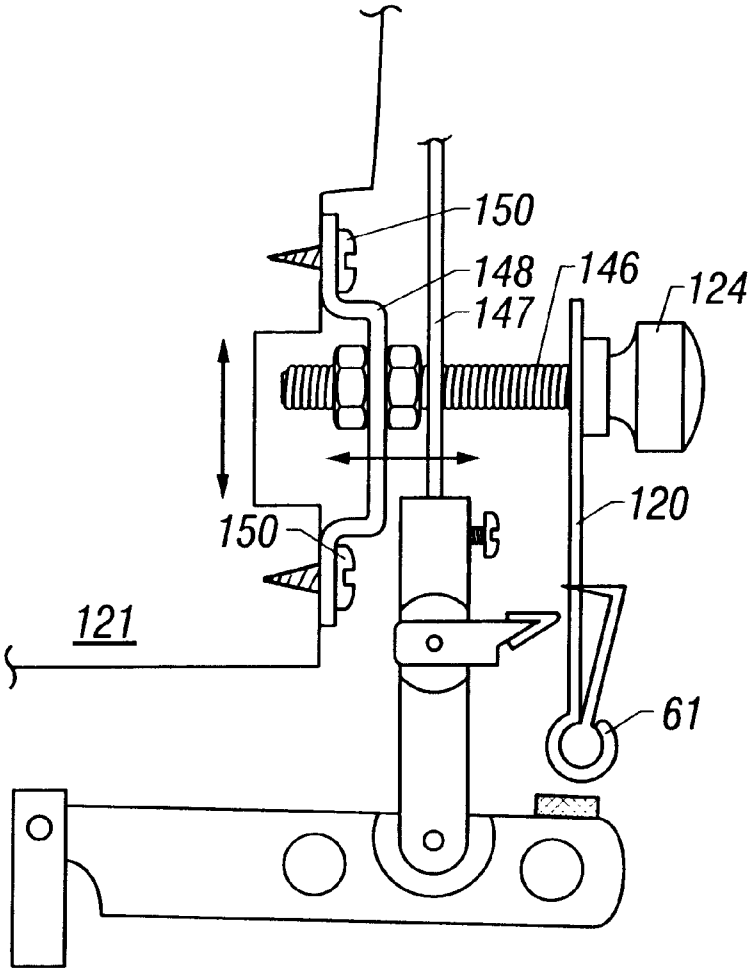
FIGS. 5A–5C show additional alternative embodiments for mounting the stop rail to a piano.
Figure 5A:
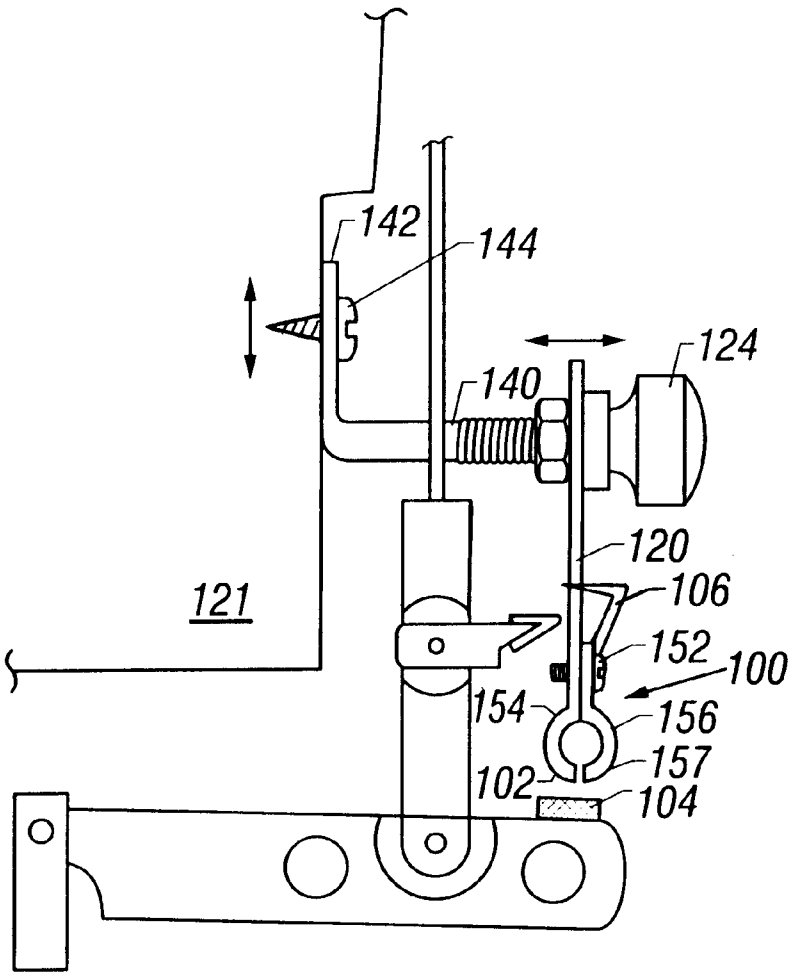

Other methods of adjustably attaching stop rail 100 to the case of a piano are shown in FIGS. 5A and 5B. Referring to FIG. 5A, bracket 120 is case mounted by attaching thumbscrew 124 to an angled, e.g. ninety degree, bolt 140. In this embodiment, bolt 140 includes a slot 142 through which a screw 144 extends to mount bolt 140 to the piano case 121 to provide vertical adjustment of stop rail 100. Referring to FIG. 5B, here bracket 120 is case mounted by attaching thumbscrew 124 to a bolt 146 and a case bracket 148. Bolt 146 extends through a slot 147 in case bracket 148. Case bracket 148 is mounted to the piano case 121 with screws 150. Slot 147 permits vertical adjustment of stop rail 100.

Figure 5C:
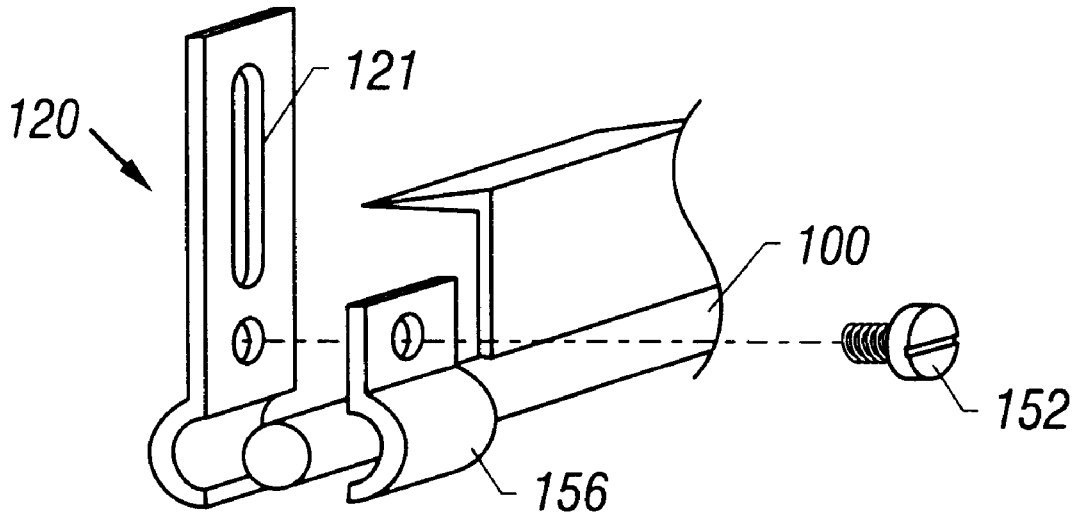

FIGS. 5A and 5C also show an alternative method for fastening stop rail 100 to bracket 120. Sostenuto blade 106 is attached to bracket 120 with a clamping plate 156 and screw 152. Bracket 120 has a slot 121 permitting adjustment of the position of bracket 120. Damper stop 102 is held in place by a looped end 154 of bracket 120 and a looped end 157 of clamping plate 156.

Figure 6A:
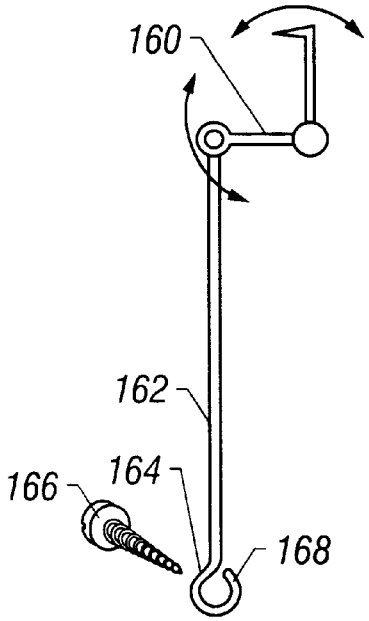
FIG. 6A–6C show various methods for coupling the stop rail to a sostenuto pedal.
Figure 6B:
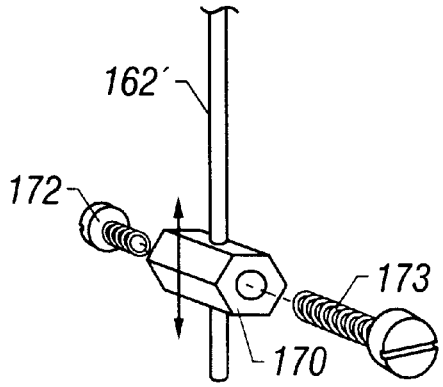
Figure 6C:
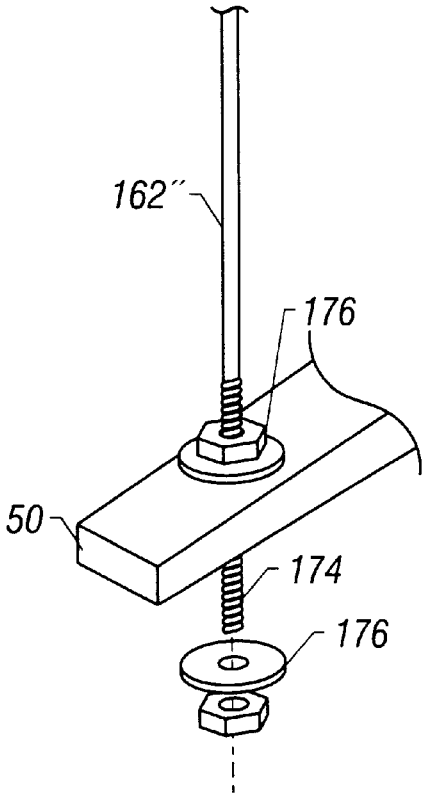

FIGS. 6A–6C show examples of methods to link stop rail 100 to sostenuto pedal 52. Referring to FIG. 6A, a lower end 164 of rod 162 is attached to pedal lever 50 by a screw 166 extending through a loop end 168 of rod 162. Referring to FIG. 6B, to provide vertical adjustment of rod 162' a lock nut 170 is slidably received by rod 162' and locked in place with a set screw 172. A bolt 173 passes horizontally through pedal lever 50 and is received within lock nut 170 to fixedly connect lock nut 170 to pedal lever 50. In FIG. 6C, rod 162''' passes vertically through pedal lever 50. Rod 162'' is threaded at 174 and locked in position with nuts and washers 176.

Figure 7A:
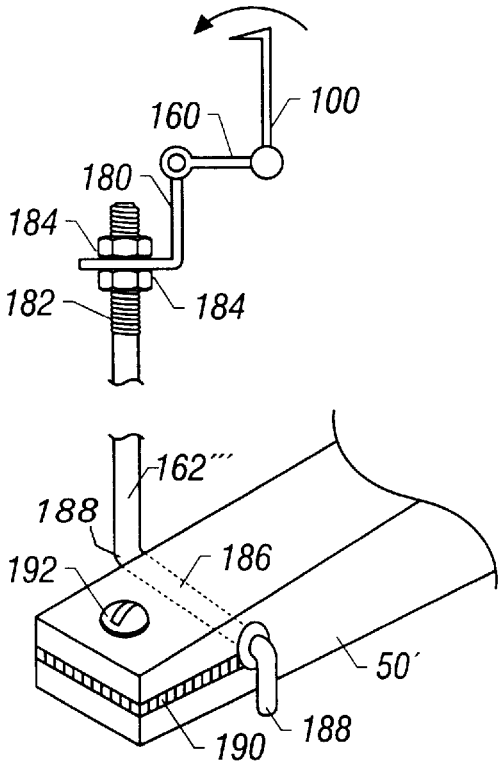
FIG. 7A and 7B show additional alternative embodiments for coupling the stop rail to a sostenuto pedal.
Figure 7B:
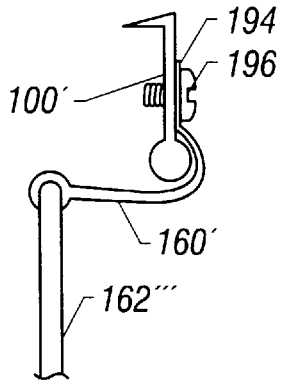

Vertical adjustment of rod 162''' can be provided by adjustably mounting rod 162''' to stop rail 100. Referring to FIG. 7A, a connecting arm 180 extends between extension 160 and rod 162'''. Rod 162''' is threaded at 182 and connecting arm 180 is adjustably mounted to rod 162 with nuts 184. Referring to FIG. 7B, here extension 160' is modified to include a slotted portion 194 which is adjustably mounted to stop rail 100' by a screw 196. FIG. 7A also shows an alternative method for attaching rod 162''' to pedal lever 50'. The lower end 186 of rod 162''' has two right angle bends 188. Lower end 186 is rigidly connected to pedal lever 50' by placing the rod in a slit 190 in lever 50' and closing the slit with a screw 192.

Figure 8E:
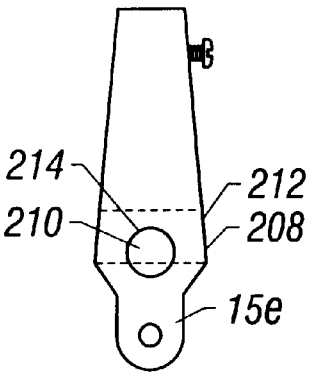
FIGS. 8A–8E illustrate various embodiments of a topflange for use with the stop rail of the invention.
Figure 8D:
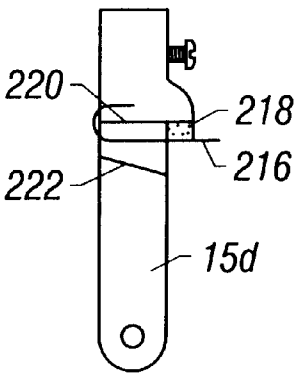
Figure 8C:
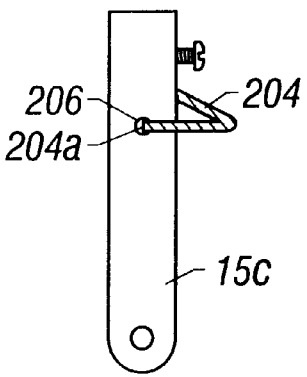
Figure 8B:
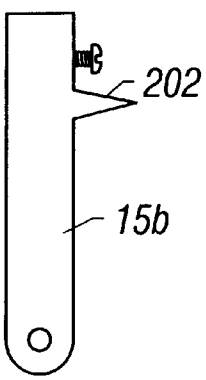
Figure 8A:
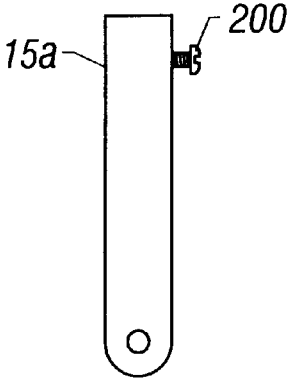

FIGS. 8A–8F show various alternative configurations of a topflange. In FIG. 8A, a topflange 15*a* includes a round-head screw 200 which is engaged by sostenuto rail blade 41. In FIG. 8B, a topflange 15*b* includes a molded, rigid tab 202 which is engaged by rail blade 41. In FIG. 8C, a topflange 15*c* includes a triangular tab 204 formed of rigid or flexible material. Tab 204 is secured to topflange 15*c* by inserting an enlarged end 204*a* of tab 204 into a notch 206 in topflange 15*c*. In FIG. 8*d*, a topflange 15*d* includes a spring tab 216 resting against a felt 218. Spring tab 216 is received within a notch 220 in topflange 15*d* that has an angled wall 222 enabling deflection of the spring tab. In FIG. 8*e*, a topflange 15*e*, incorporating any of the described tabs, includes a widened base area 208 having openings 210, 212 into which dampening weights 214 can be inserted. A flexible sostenuto rail blade, described below, is used with topflanges having a rigid tab.

Figure 9E:
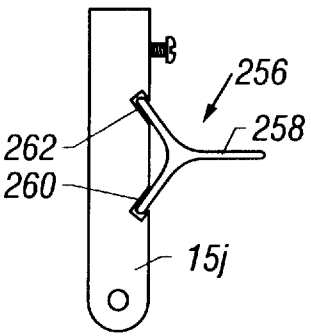
FIGS. 9A–9E shows additional alternative embodiments of topflanges for use with the stop rail of the invention.
Figure 9D:
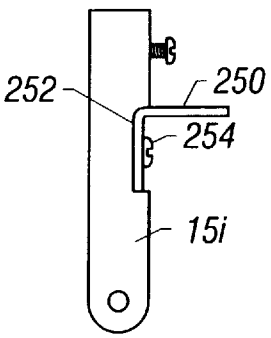
Figure 9C:
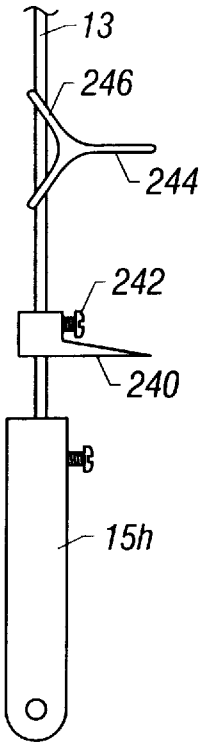
Figure 9B:
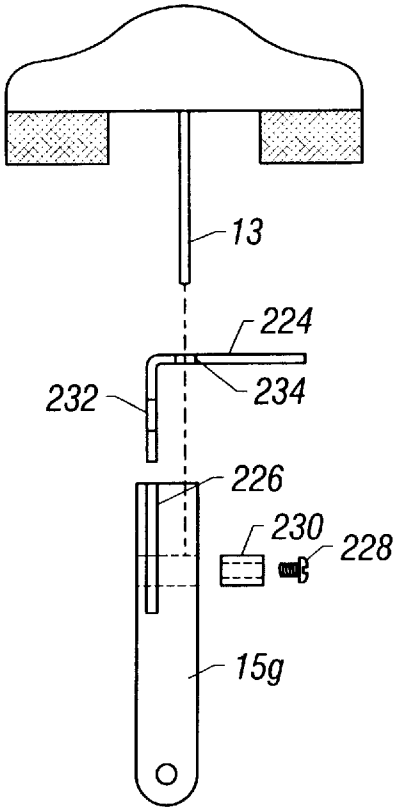
Figure 9A:
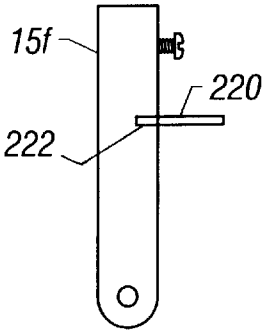

FIGS. 9A–9E show additional alternative embodiments of a tab. In FIG. 9A, a thin, flexible tab 220 is press fit into a slot 222 in topflange 15*f*. In FIG. 9B, a ninety degree bent tab 224 is inserted into a vertical slot 226 in topflange 15*g* and then secured by a screw 228 passing through a barrel 230 and a first hole 232 in tab 224, and by damper wire 13 passing through a second hole 234 in tab 224. In FIG. 9C, two alternative embodiments of a tab attached to damper wire 13 of topflange 15*h* are shown. Tab 240 is attached to wire 13 by a retaining screw 242. Tab 244 is attached to wire 13 by a compression clip 246. In FIG. 9D, a ninety degree tab 250 is attached to topflange 15*i* within a recess 252 in the topflange by a screw 254. In FIG. 9E, a tab 256 is in the form of a compression clip 258 wedged into two slots 260, 262 in topflange 15*j*.

Figures 10A, 10B, 10C, 10D, 10E, 10F, 10G:
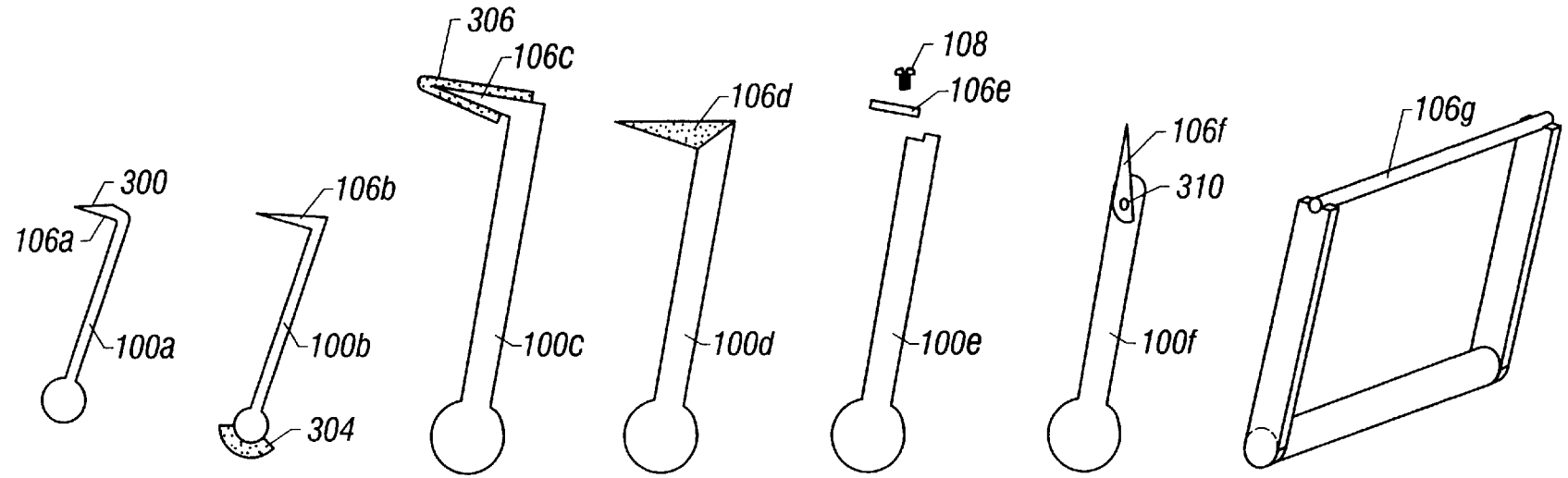
FIGS. 10A–10G illustrate various embodiments of the stop rail of the invention.

FIGS. 10A–10H show alternate designs for the stop rail. In FIG. 10A, blade 106*a* of stop rail 100*a* has a beveled edge 300. A stop felt strip 304 is attached to stop rail 10*b* of FIG. 10B, rather than attaching the stop felt 104 to individual underlevers 17, as shown in FIG. 3. In FIG. 10C, blade 106*c* is covered with soft material 306, such as felt, rubber or plastic, to suppress noise between blade 106 and tab 47. In FIG. 10D, blade 106*d* is formed entirely of a soft compliant material such as felt, rubber or plastic. In FIG. 10E, blade 106*e* is removably attached to stop rail 100*e* with a screw 308. This form of attachment permits adjustment of the position of blade 106*e*. In FIG. 10F, blade 106*f* is rotatably mounted to stop rail 100*f* by a pivot pin 310. In FIG. 10G, blade 106*g* is shown as a rod, wire or similar object of small cross-sectional dimension.

Figure 11A:
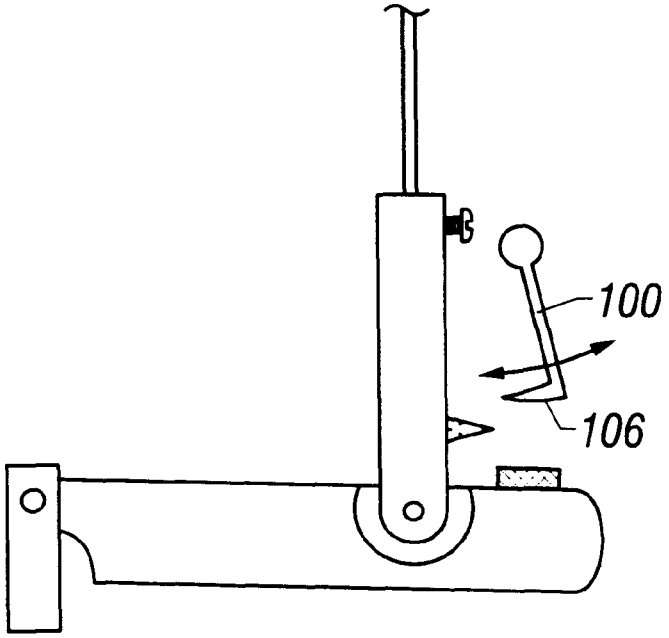
FIGS. 11A–11D show various configurations of mounting of the stop rail relative to the topflange.
Figure 11B:
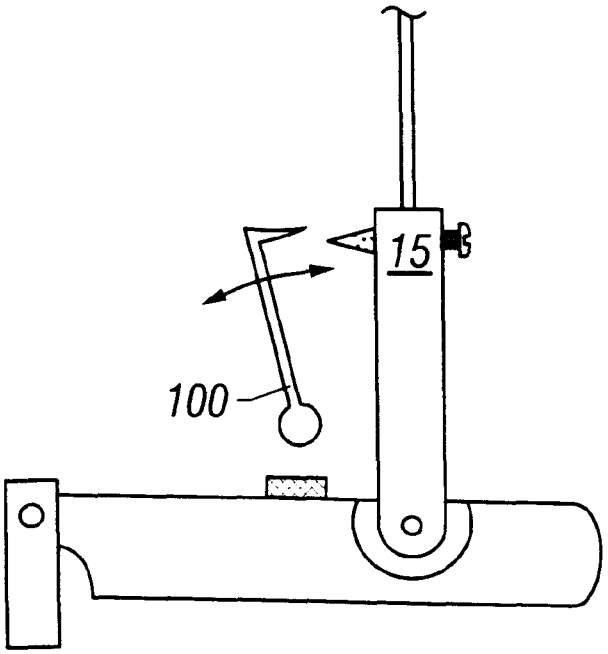
Figure 11C:
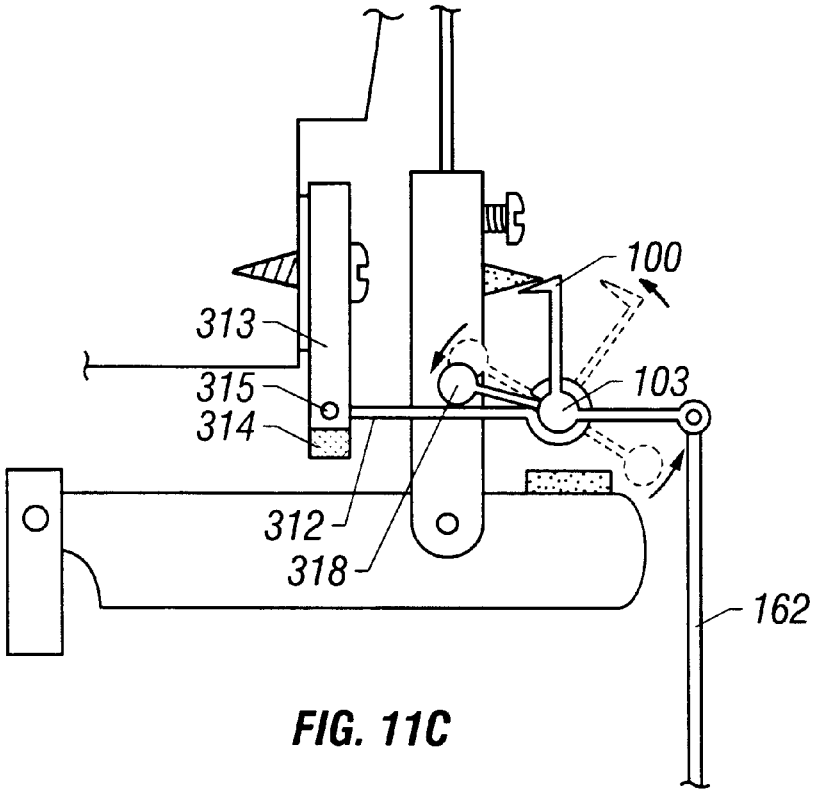

FIGS. 11A–11D show alternative placements of stop rail 100. In FIG. 11A, stop rail 100 is inverted such that blade 106 provides both the sostenuto function and the damper stop function. In FIG. 11B, stop rail 100 is positioned on the opposite side of topflange 15. In FIG. 11C, section 103 of stop rail 100 is pivotally mounted to a bracket 312. The bracket is attached to the piano by a flange or rail 313. Bracket 312 can be rotated with respect to rail 313 about pivot 315, e.g., by adjustment screws, pedals, levers, or similar actuating devices, permitting adjustment of the position of stop rail 100.

Figure 11D:
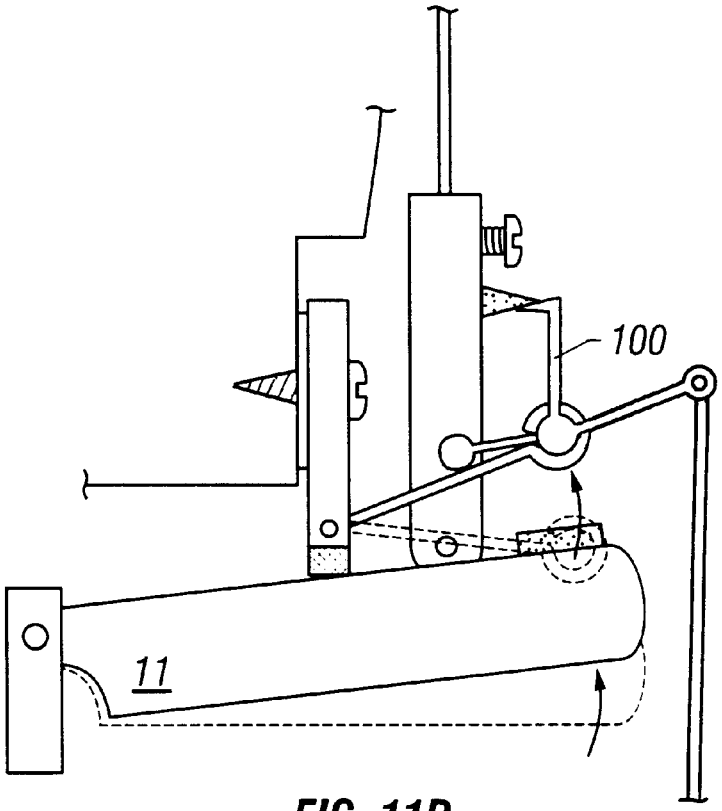

Referring also to FIG. 11D, during initial motion of rod 162, stop rail 100 rotates into position against tab nose 47. This motion causes a stop member 318 rigidly connected to stop rail 100 to rotate into contact with bracket 312. Under further motion of rod 162, stop member 318 prevents stop rail 100 from rotating such that bracket 312 rotates about pivot 315, lifting stop rail 100. Rail 313 also optionally includes a stop felt 314 to assist in the damper stop function.

Figure 12A:
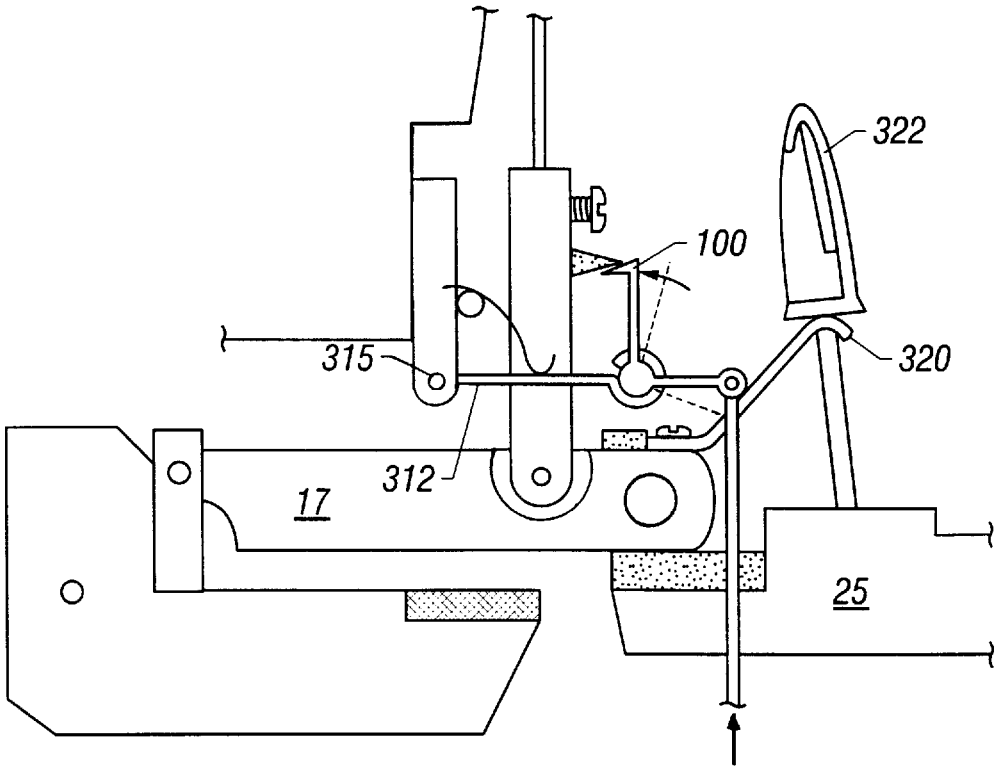
FIGS. 12A–12C show methods of linking an underlever of the piano with a piano key.
Figure 12B:
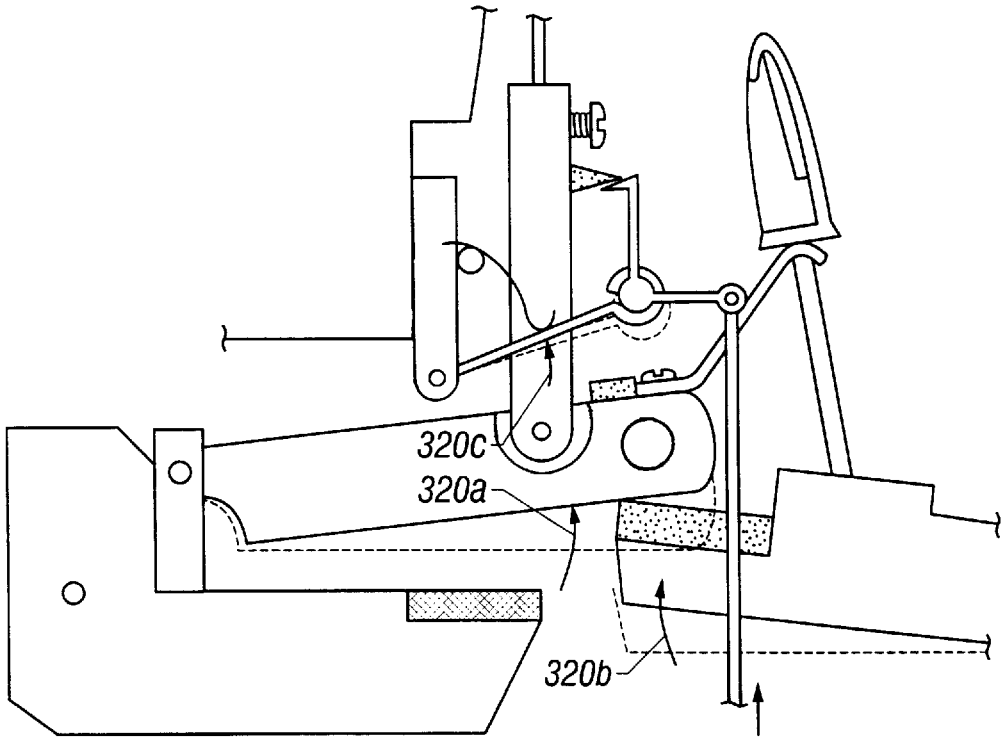
Figure 12C:
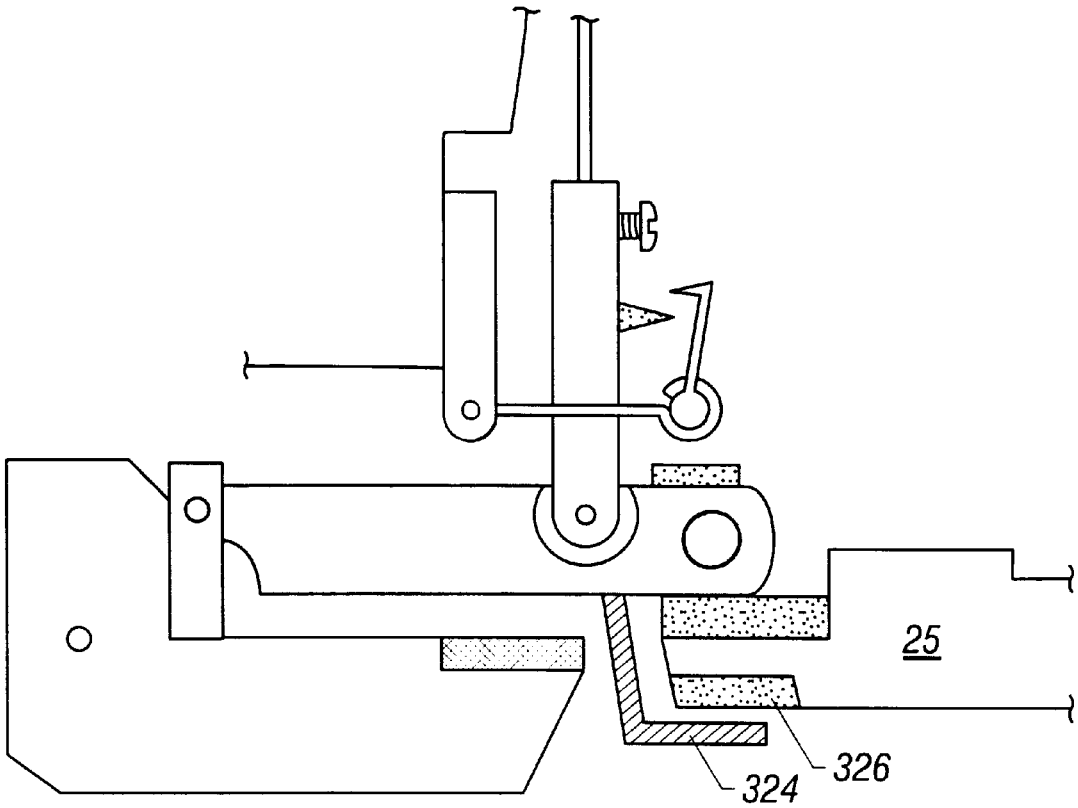

If the rotating bracket of FIG. 11C is employed to permit the user to selectively raise stop rail 100, thus raising a captured damper 11 higher, the lifting of the damper can be linked with other parts of the piano such as the key action. Referring to FIGS. 12A and 12B, after capturing the damper in its raised position with stop rail 100, further elevation of the stop rail caused by rotating bracket 312 about pivot 315 acts to lift underlever 17. Underlever 17 is linked to key 25 by a forked link 320 which can lift the back check 322 of the piano action. This results in restriking the hammer against the string. In FIG. 12C, an alternative link 324 is shown which contacts a bottom surface 326 of key 25.

Figure 13A:
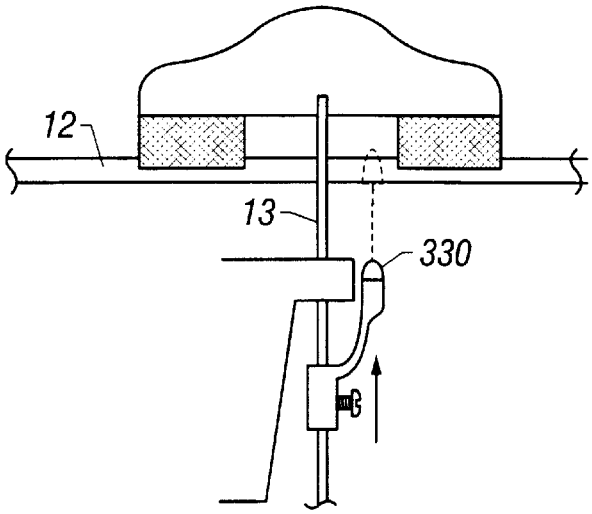
FIGS. 13A–13C show various components linked to a damper wire of the piano.
Figure 13B:
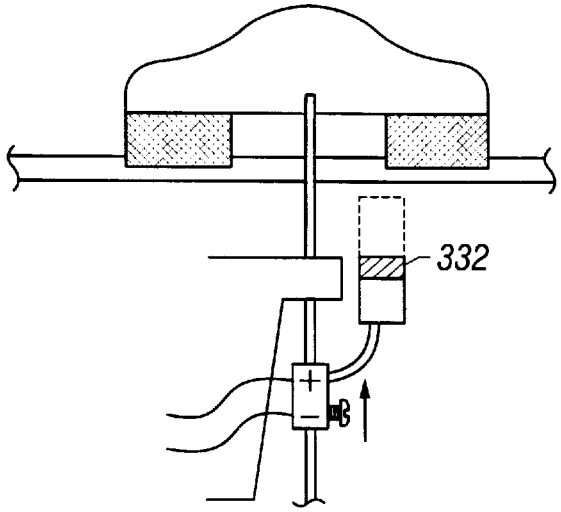
Figure 13C:
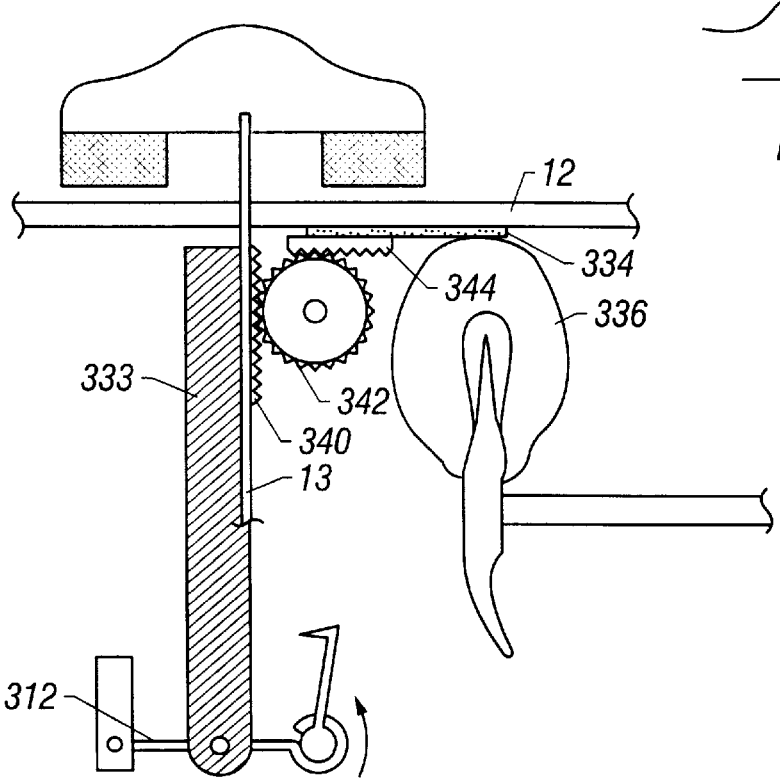

The additional lift provided by rotating bracket 312 can be used to selectively apply various components to string 12. Referring to FIG. 13A, a muting or silencing member 330 in the form of a wedge of felt, rubber or similar material is lifted and inserted between the strings in response to rotation of bracket 312 for the purpose of muting and/or silencing portions of the piano. In FIG. 13B, an electronic sensor 332 is positioned close to the string in response to rotation of bracket 312 for the transfer of string-generated information into other systems such as amplifiers, player piano mechanisms or computers. In FIG. 13C, a member 334 formed of soft muting material is moved into position between the piano hammer 336 and string 12 for the purpose of softening or altering the sound of the piano. To move member 334, when a rod 333 attached to bracket 312 is further raised by rotation of the bracket, a gear 340 attached to rod 333 is raised, causing rotation of a gear 342, which in turn causes linear motion of a gear 344 attached to member 334.

What is claimed is:

1. A piano comprising an underlever assembly including:

an underlever arm mounted for movement between a first, at-rest position and a second position, an underlever support joining the underlever arm to a string damper such that movement of the underlever arm between its first position and its second position causes movement of the string damper, the underlever support defining a latch surface, a latch and latch mount, the latch being mounted to the latch mount for movement between a non-latching position and a latching position, the latch in its latching position engaging the latch surface to maintain a position of the underlever assembly such that the underlever arm is spaced from its at-rest position and the string damper is spaced from a corresponding piano string, and a stop for limiting the motion of the underlever arm toward its second position, the stop being mounted to the latch mount.

2. The piano of claim 1 wherein the latch is mounted to the latch mount to rotate between the latching position and the non-latching position.

3. The piano of claim 1 wherein the underlever arm includes a stop surface, the stop being configured to contact the stop surface to limit movement of the underlever arm toward the second position.

4. The piano of claim 1 wherein the stop comprises a surface of the latch.

5. The piano of claim 1 wherein the latch mount is adjustably mounted to the piano.

6. The piano of claim 5 wherein the latch mount is case-mounted.

7. The piano of claim 5 wherein the latch mount is action-mounted.

8. The piano of claim 1 wherein the latch surface is flexible.

9. The piano of claim 1 wherein the latch surface is rigid.

10. The piano of claim 1 further comprising an actuator for transferring motion of a pedal to the latch.

11. The piano of claim 10 wherein the actuator is adjustably mounted to the piano.

12. The piano of claim 10 wherein the actuator is attached to the pedal by a fastener extending through a loop end of the actuator.

13. The piano of claim 1 wherein the latch mount is configured to be lifted by motion of a pedal.

14. A piano comprising an underlever assembly including:

an underlever arm mounted for movement between a first, at-rest position and a second position, the underlever arm including a stop surface, an underlever support joining the underlever arm to a string damper such that movement of the underlever arm between its first position and its second position causes movement of the string damper, the underlever support defining a latch surface, a latch and latch mount, the latch mounted to the latch mount to rotate between a non-latching position and a latching position, the latch in its latching position engaging the latch surface to maintain a position of the underlever assembly such that the underlever arm is spaced from its at-rest position and the string damper is spaced from a corresponding piano string, and a stop configured to contact the stop surface to limit movement of the underlever arm toward its second position, the stop being mounted to the latch mount.

15. A piano comprising an underlever assembly including:

an underlever arm mounted for movement between a first, at-rest position and a second position, an underlever support joining the underlever arm to a string damper such that movement of the underlever arm between its first position and its second position causes movement of the string damper, the underlever support defining a flexible, triangular tab, a blade having a beveled edge and a vertical bracket, the blade being mounted to the bracket for movement between a non-latching position and a latching position, the blade in its latching position engaging the tab to maintain a position of the underlever assembly such that the underlever arm is spaced from its at-rest position and the string damper is spaced from a corresponding piano string, and a stop for limiting the motion of the underlever arm toward its second position, the stop being mounted to the bracket.

16. A method for controlling a piano string damper, comprising:

contacting an underlever arm of a piano with a latch mounted to a latch mount of the piano to maintain a position of the underlever arm, an underlever support joining the underlever arm to the string damper such that the string damper is maintained spaced from a corresponding piano string when the underlever arm contacts the latch, and contacting the underlever arm with a stop mounted to the latch mount, contact of the underlever arm with the stop acting to limit movement of the underlever arm from an at-rest position.

* * * * *

UNITED STATES PATENT AND TRADEMARK OFFICE

CERTIFICATE OF CORRECTION

PATENT NO. : 6,020,544

DATED : FEBRUARY 1, 2000

INVENTOR(S) : MARVIN S. JONES, PETER M. BARNA, ANTHONY C. ARENA, WILLIAM S. YOUSE AND MICHAEL MOHR

It is certified that error appears in the above-identified patent and that said Letters Patent is hereby corrected as shown below:

In Column 3, Line 5 delete "da per" and insert --damper--.

Signed and Sealed this

Third Day of April, 2001

*Attest:*

Nicholas P. Godici

NICHOLAS P. GODICI

*Attesting Officer*

*Acting Director of the United States Patent and Trademark Office*